US005664697A

United States Patent [19]

Lambelet, Jr. et al.

[11] Patent Number: 5,664,697

[45] Date of Patent: Sep. 9, 1997

[54] AUTOMATICALLY ADVANCING PILL REGIMEN DEVICE

[75] Inventors: Lawrence E. Lambelet, Jr., Flemington, N.J.; Thomas A. Frazier, Williamsport, Pa.

[73] Assignee: Ortho Pharmaceutical Corporation, Raritan, N.J.

[21] Appl. No.: 551,223

[22] Filed: Oct. 31, 1995

[51] Int. Cl.[6] ..... G07F 11/00

[52] U.S. Cl. ..... 221/5; 221/86; 221/89; 206/533

[58] Field of Search ..... 221/82, 83, 86, 221/89, 91, 4, 5, 282; 206/533, 538, 539

[56] References Cited

U.S. PATENT DOCUMENTS

| | | | |
|---|---|---|---|
| 3,437,236 | 4/1969 | Huck | 221/86 |
| 3,557,747 | 1/1971 | Rigney et al. | 206/533 |
| 3,895,737 | 7/1975 | Phillips | 221/82 |
| 3,984,031 | 10/1976 | Thompson | 221/82 |
| 4,078,661 | 3/1978 | Thomas | 206/533 |
| 4,128,188 | 12/1978 | White | 221/91 |
| 4,165,709 | 8/1979 | Studer | 221/5 |
| 4,646,936 | 3/1987 | Frazier et al. | 221/86 |
| 5,154,296 | 10/1992 | Cutler | 221/91 |
| 5,409,132 | 4/1995 | Kooijmans et al. | 221/86 |

FOREIGN PATENT DOCUMENTS

| | | | |
|---|---|---|---|
| 1187060 | 4/1970 | United Kingdom | 221/82 |

*Primary Examiner*—H. Grant Skaggs
*Attorney, Agent, or Firm*—Paul A. Coletti

[57] ABSTRACT

The present invention is directed to a self-actuating dispenser for a regimen of pills satisfying the needs discussed herein above. A self-actuating dispenser having the features of the present invention comprises a base, a pill container, and a means for cyclically indexing the pill container with respect to the base. The base has a pill exit aperture. The pill container, which houses the pills in individual compartments or cells, is movably attached to the base such that any pill cell can be aligned with the pill exit aperture. The pill cells are provided with open bottoms for loading and dispensing which are covered over by the base when attached thereto. The means for cyclically indexing provides that each pill cell in turn is brought into alignment with the pill exit aperture thereby singly dropping the resident pills in a series of dispensing cycles.

24 Claims, 10 Drawing Sheets

AUTOMATICALLY ADVANCING PILL REGIMEN DEVICE

BACKGROUND OF THE INVENTION

Medicaments and other pharmaceutical preparations are often prescribed for a timed therapy. In the case of solid dosage forms, such as tablets or pills, the drug dose is in premeasured units and the therapy is dependent upon the administration of multiple units over a course of time. Often, this administration is done by the patient at home and away from the discipline of the clinical environment. In this circumstance, packages which assist the patient to be compliant with the regimen of therapy are of particular value.

Frequently the course of solid dose therapy requires a periodic habit. Tablets or pills used for birth control, for regulating blood pressure, for antibiotic administration, for maintenance of a diabetic condition, and for a variety of other ailments are taken in regular intervals over extended periods of time. Sometimes the tablets or pills are organized into cycles which are replenished at anniversaries of the starting time. In the case of some preparations, such as birth control pills, the drug dose is sometimes varied within a discrete serial of pills in order to administer the minimal amount of drug as required by a time-phased bodily cycle, such as ovulation. In other circumstances, placebos are added to the regimen at an appropriate interval to fill out the cycle. In all such cases, it is important for the package to maintain the pills in a specific sequence.

Sequence-maintaining tablet dispensers and devices for dispensing solid form pharmaceutical preparations are known. Occasionally these are in the form of push-through blister packages consisting of a film, such as polyvinyl chloride, formed into pockets which contain the pills, lidded over with a frangible material, such as aluminum foil. The sequence is indicated by an array in rows representing a cycle by the left-to-right convention; or, otherwise, in a loop, such as a circle or oval, with a defined circuit direction. Sometimes the pills are contained in the individual cells of a rigid container formed of a molded plastic. In such containers, the cells are typically in a circular array that can be indexed to a fixed dispensing location where a selected pill can be expelled through an exit feature. The period or cycle is usually indicated by labelling which is pre-applied to the dispenser by the manufacturer or, otherwise, can be applied by the patient. When the labelling is pre-applied, it is sometimes provided with an adjustment feature, The patient-applied, or adjusted, labelling allows for a variable start to the period of administration which is otherwise fixed by the species of the dispenser provided. In the case of birth control pills, the cycle is typically either 21 or 28 days, the labelling indicates days-of-the-week, and the fixed start day is usually Sunday.

The aspect of patient compliance with respect to drugs administered in dispensing systems has been studied. The regularity of patient behavior is vitally important to the therapy. If birth control pills are not taken daily when indicated, for example, there is a risk for pregnancy, constituting a catastrophic failure of the therapy. Making up the missed pills at a later time is not always effective. Healthcare today is tending more and more toward self-care at home. Packages which assist the patient in compliant behavior, therefore, are becoming increasingly important for efficacy.

Two of the factors which significantly influence desired behavior are limiting the choices to be made by the patient and making the package system convenient to use. Regarding the first factor, the patient using a typical pill dispensing package is guided to a sequence by labeling, or by convention, but is still required to make a selection of the correct pill, This selection process is simplified in the single-port dispensing systems, wherein the pill array is rotated or transported to a single exit port, by reducing the selection process to a simple indexing action, such as advancing the mechanism one position. Even in the single-port dispensing system, however, a mistake can be made by advancing too far. In fact, any single pill within any package of today's technology can be taken at will by the patient.

Convenience is also linked to compliance. Incentive to comply is normally provided by the ailment or condition treated or prevented by the drug therapy. It is well known, however, that compliance sometimes lapses even under such incented circumstances when the administration spans long periods of time. In the case of birth control, the administration period can last for years, possibly spanning the whole of fertile adulthood. The key to compliance, therefore, is to establish a habitual behavior that becomes automatic without reliance upon aids for memory. Since incentive is already provided, enhancement can be directed to the removal of disincentives. One type of disincentive is the multiple-step operation procedure of the dispensing package. After an initial set up, the typical sequence-maintaining package requires two operational steps for actuation. The first is to select the correct pill, aided by the labeling, and the second is to express the selected pill. An improvement would be to select unaided and express, all in one single step.

It is therefore an object of the present invention to regulate access to the pills such that only the correct pill of the sequence can be dispensed in any dispensing episode. Further, the present invention provides a convenient one-step, self-actuating mode of operation. Other features and purposes of the present invention include the provision of a protective envelope in the form of a shell for maintenance of the pill regimen during the administration period and the capability of replenishing the pill regimen through provision of a refill unit, thereby allowing reuse of the durable envelope and preventing wastage of valuable material. Also included is the capability of customizing a starting indicator of periodicity for the regimen through adjustable labeling. As the labeling is no longer needed with the present invention to aid in selection, it serves to reliably remind the patient if the dispensing event has already occurred. It is a further object of the present invention to enhance manufacturability by providing, through design, componetry which can be fabricated with homogeneous materials and processes and which can be easily assembled by interlocking fits.

SUMMARY OF THE INVENTION

The present invention is directed to a self-actuating dispenser for a regimen of pills satisfying the needs discussed herein above. A self-actuating dispenser having the features of the present invention comprises a base, a pill container, and a means for cyclically indexing the pill container with respect to the base. The base has a pill exit aperture. The pill container, which houses the pills in individual compartments or cells, is movably attached to the base such that any pill cell can be aligned with the pill exit aperture. The pill cells are provided with open bottoms for loading and dispensing which are covered over by the base when attached thereto. The means for cyclically indexing provides that each pill cell in turn is brought into alignment with the pill exit aperture thereby singly dropping the resident pills in a series of dispensing cycles.

In a preferred embodiment of the invention, the means for cyclically indexing comprises the movement of inclined surfaces compressed together by a force acting in one plane to produce rotational movement in a perpendicular plane. Such a force is applied by pivoting a plunger having a sliding shoe against a series of saw-tooth-like ramps arrayed circularly around the pill container and positioned in a way to provide a translation of the pill container relative to the exit aperture by a pill cell spacing with each pivot stoke. The source of power is provided by the clamping together of the thumb and fingers of one hand. The pivoting feature is provided with a spring to reciprocate the stroke upon removal of pressure against the plunger. The geometry of the saw teeth and the sliding shoe provide for bypass of these features so that a new purchase on the next advancing saw tooth can be gained to complete a full cycle.

In another preferred embodiment of the invention, the self-actuating dispenser is provided with a protective shell having an aperture through which to pass the pill. The protective shell also has a means for making a removable connection to the self-actuating dispenser thereby permitting reuse of the shell. In yet another preferred embodiment, the self-actuating dispenser is provided with a changeable set of indicators of periodicity.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
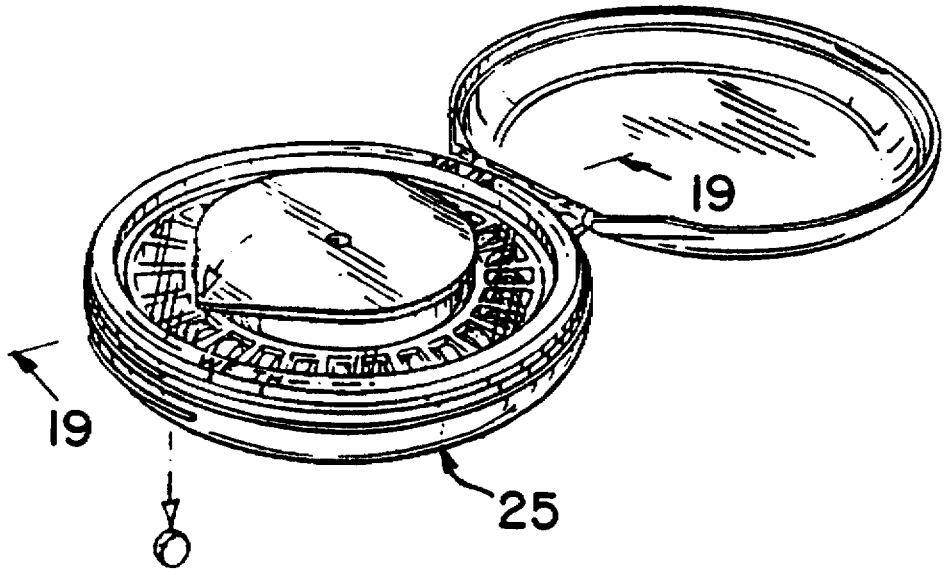
FIG. 1 is a perspective view of the opened dispenser showing a pill being dispensed.
Figure 3:
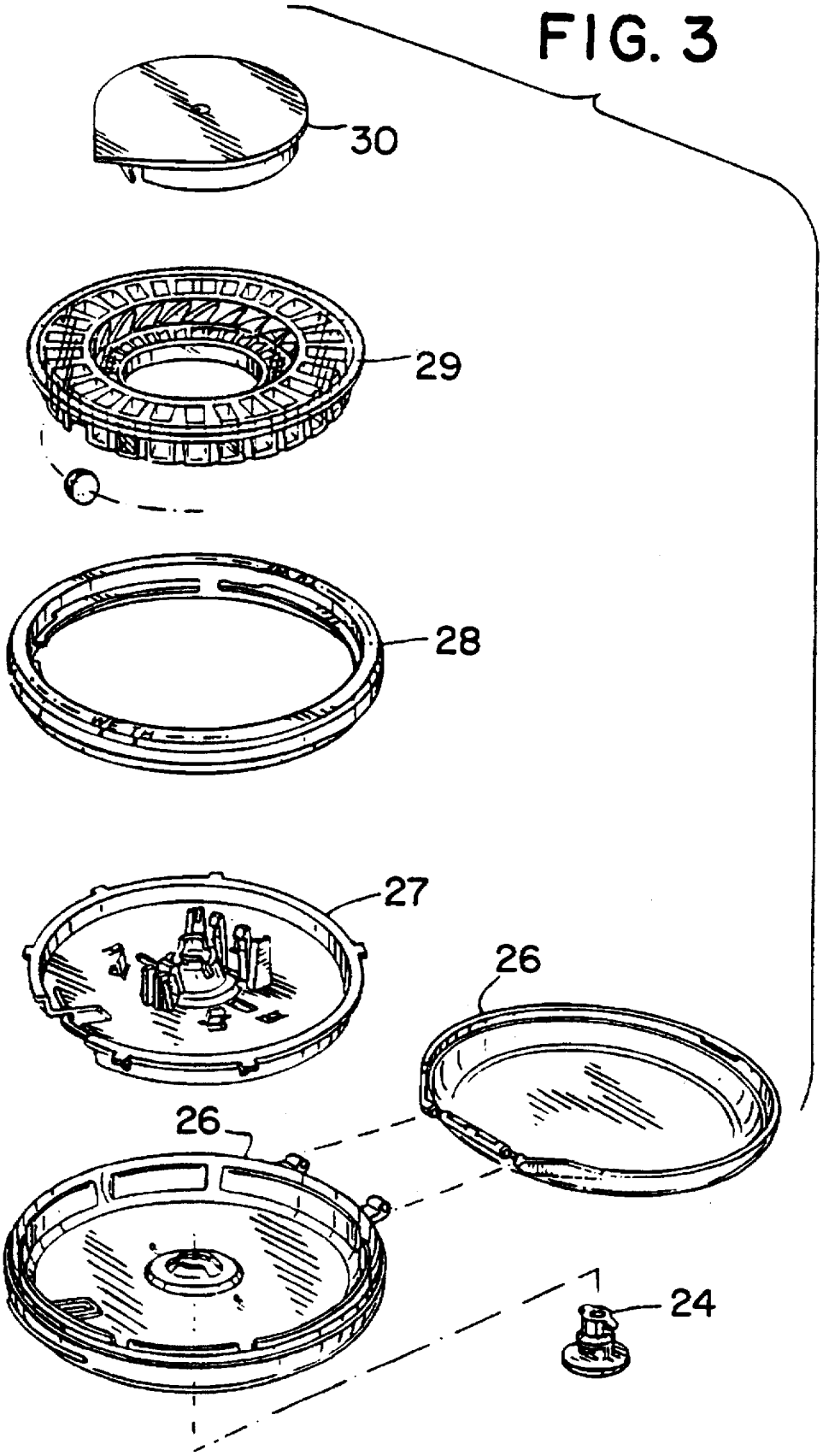
FIG. 3 is an exploded view of the dispenser of FIG. 1 showing the major componentry.

The preferred embodiment illustrated in the accompanying figures is described in detail below with reference to such figures and the numbers provided therein:

FIG. 3 is an exploded view a dispenser 25 shown in FIG. 1 which is open and ready to dispense pills. FIG. 3 illustrates the major components of the system and is useful for an overview description. Referring to FIG. 3, a hinged shell 26 is shown in an exploded view where bottom and top portions are separated at the hinge. A base 27 is locked into the bottom portion of the hinged shell 26 with a plug connector 27. A periodicity indicator ring 28 encircles a pill container 29 to which a variable orientation is maintained. The pill container 29 is rotatably connected to the base 27 captivating the periodicity indicator ring 28 therebetween. A plunger 30 is pivotally connected to the base 27 and interacts with the pill container 29 in way to rotate the pill container into an alignment position where pills contained therein are free to drop though coincident openings in the pill container 29, base 27 and hinged shell 26.

Pill Container Component

Figure 10:
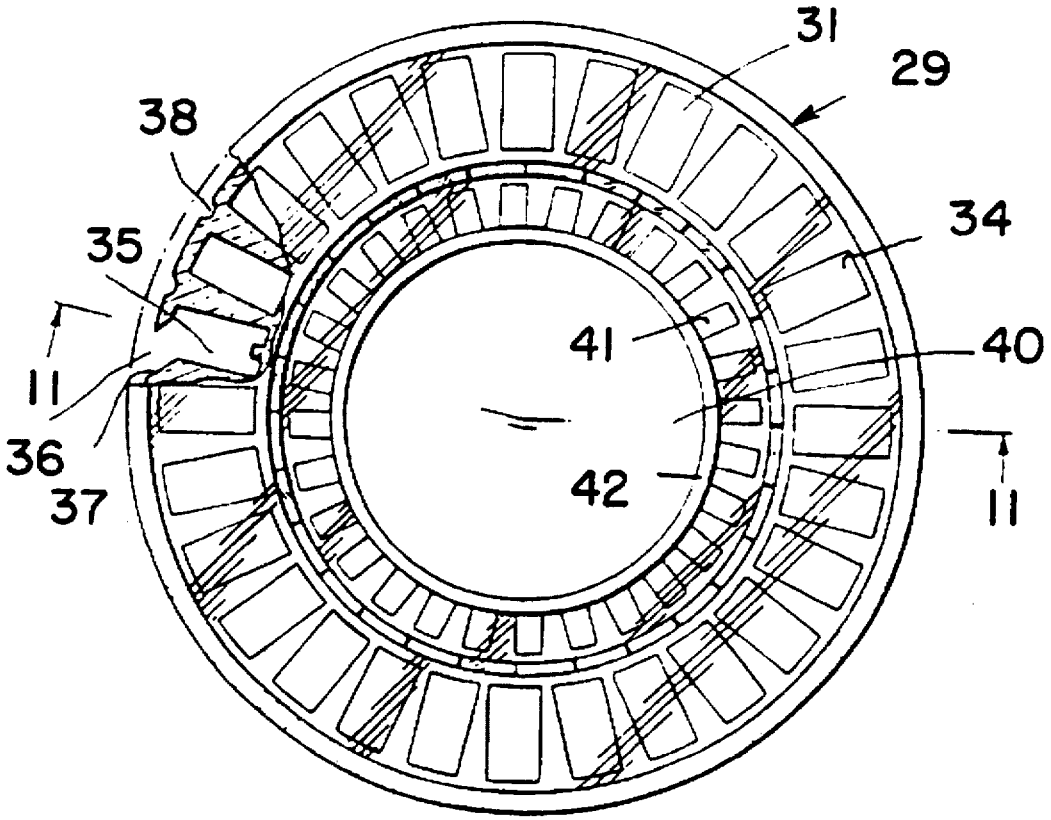
FIG. 10 is a top plan view with a partial sectional view described thereon of a pill container component illustrated in FIG. 3.
Figure 11:
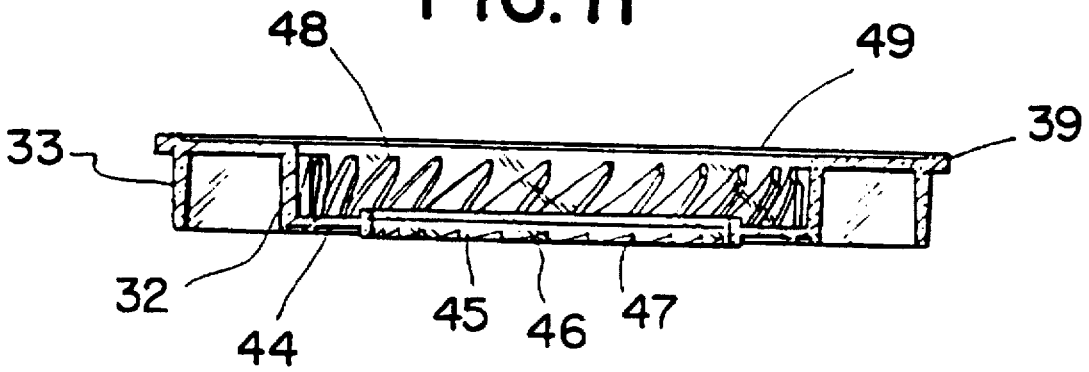
FIG. 11 is sectional view of the pill container taken across lines 11—11 of FIG. 10.

FIGS. 10 and 11 illustrate the preferred embodiment of the pill container 29 which, in addition to other functions, houses the regimen of pills. As shown in FIG. 10, the pill container is comprised of pill cells 31 arrayed evenly in a circle. Each pill cell is sized to contain one pill and has four side walls, a top surface and an open bottom. The size of the circle is determined by the number of pills in the regimen. The pill cells 31 collectively form an inner wall 32 and an outer wall 33, best viewed in FIG. 11, and a top surface 34, best viewed in FIG. 10. The pill container 29 is made of clear material, such as a transparent plastic, so that the pills are visible and, in particular, so that the number of empty and filled pill cells can be observed. The pill cells 31 receive pills loaded from the bottom. A last pill cell 35 is designated for the last sequential pill of the regimen. The last pill cell 35 has a last pill slot 36 in the outer wall portion covering the last pill cell 35, as shown in the partial view of FIG. 10. The last pill slot 36 is open at the bottom and extends to a partial elevation of the outer wall 33. The last pill slot 36 is bordered on one side by an angled surface 37 in the pill cell side wall. The angled surface 37 serves to cam an interpenetrating, flexible feature extending through the last pill slot 36 out of the interior of the last pill cell 35 when the pill container 29 is rotated in a lateral plane. In the embodiment shown, the rotation is clockwise and the location of the angled surface is counterclockwise relative to the last pill slot. Also shown in the partial view of FIG. 10 are rounded vertical channels 38 in the outer wall 33 positioned in a regular array to form a one-to-one correspondence with the pill cells 31.

The top surface 34 has a bezel 39 extending outward to form a lip surrounding the pill container 29, as best viewed in FIG. 11. Referring to FIG. 10, it can be shown that the pill container 29 has a circular aperture 40 in the center which is bordered by a base flange 41 having a rim 42. The base flange 41 is attached to the bottom of the inner wall 32 and has a base flange bottom surface 44. The base flange bottom surface 44 is debossed with a circular ratchet track 45 consisting of the component of a ratchet mechanism upon which a pawl tracks. Ratchet mechanisms are well known in the mechanical arts. This embodiment, best shown in FIG. 11, is comprised of track ramps 46 inclined toward vertical stops 47 forming detents having a count equal to the number of pills in the regimen. The vertical stops 47 are aligned along radii of the circular aperture having the angular spacing equivalent to the quotient of 360 degrees and the number of pills in the regimen. The vertical stops 47 and the track ramps 46 are biased such that, with the interposition of a pawl-like object, (not shown) counterclockwise rotation of the pill container 29 is prevented by the abutment of the pawl-like object against the vertical stops 47 while clockwise rotation is facilitated by the track ramps 46 which deflect the pawl-like object downwardly creating a transition to the next index position, where the pawl-like object registers in a new detent.

Figure 20:
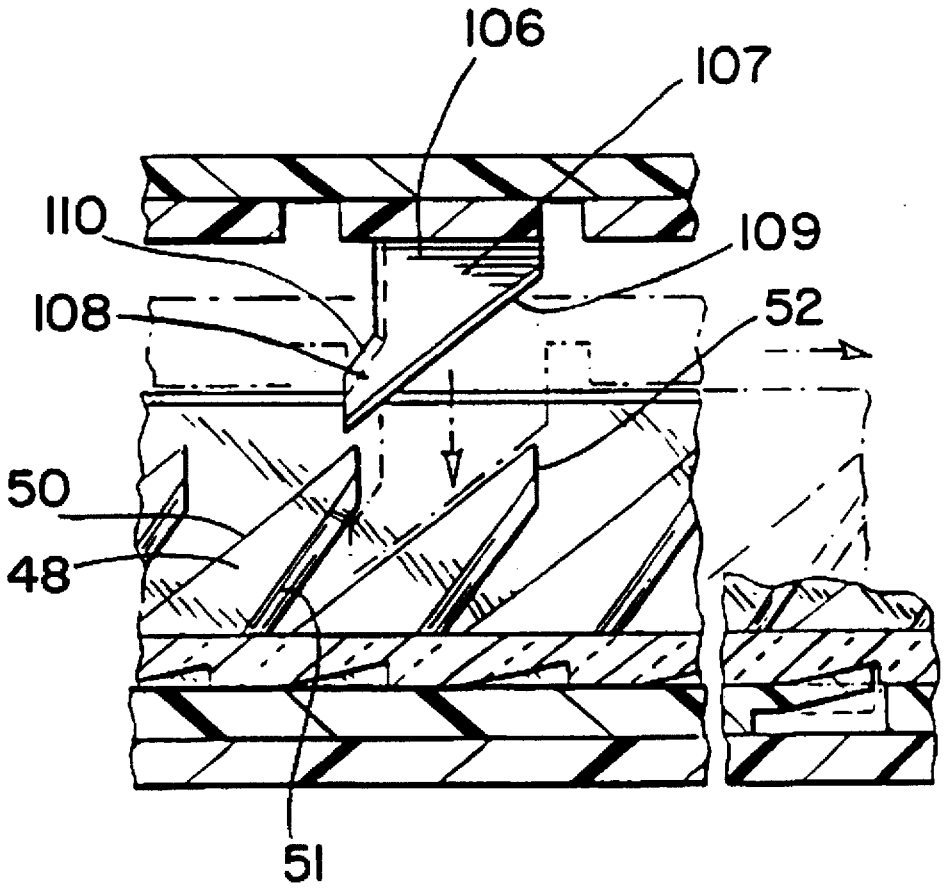
FIG. 20 is a broken sectional view of the dispenser taken across lines 20—20 of FIG. 19, showing the advancing mechanism in detail.

Referring to FIG. 11, the inner wall 32 has an embossment comprising vertical saw teeth 48 arrayed evenly around the inner wall 32 in a count equal to the number of pills in the regimen. Each saw tooth comprises an essentially wedge-shaped feature with a thickness defined by a concentrically-located bore 49. Each saw tooth further comprises three edge faces, as illustrated in the sectional view of FIG. 20. A ramp face 50 is positioned for an upward exposure, an overlap face 51 is positioned for a downward exposure, and a saw tooth abutting face 52 is positioned at the apex of the saw tooth in a vertical attitude. The ramp face 50 has a tilt to vertical and an incline to horizontal. The tilt of the ramp face 50 with respect to the inner wall 32 forms a detent, and the incline of the ramp face is sufficiently pitched so as to define a clockwise rotational movement of the pill container 29 equal to the throw of the ratchet track 45 when a sliding downward force is applied to the ramp face surface. The overap face 51 forms a bevel, gradualizing the transition from the surface of the inner wall 32 over the thickness of the saw tooth. The saw teeth 48 are oriented to the ratchet track 45 such that index positions on each are coordinated.

Base Component

Figure 6:
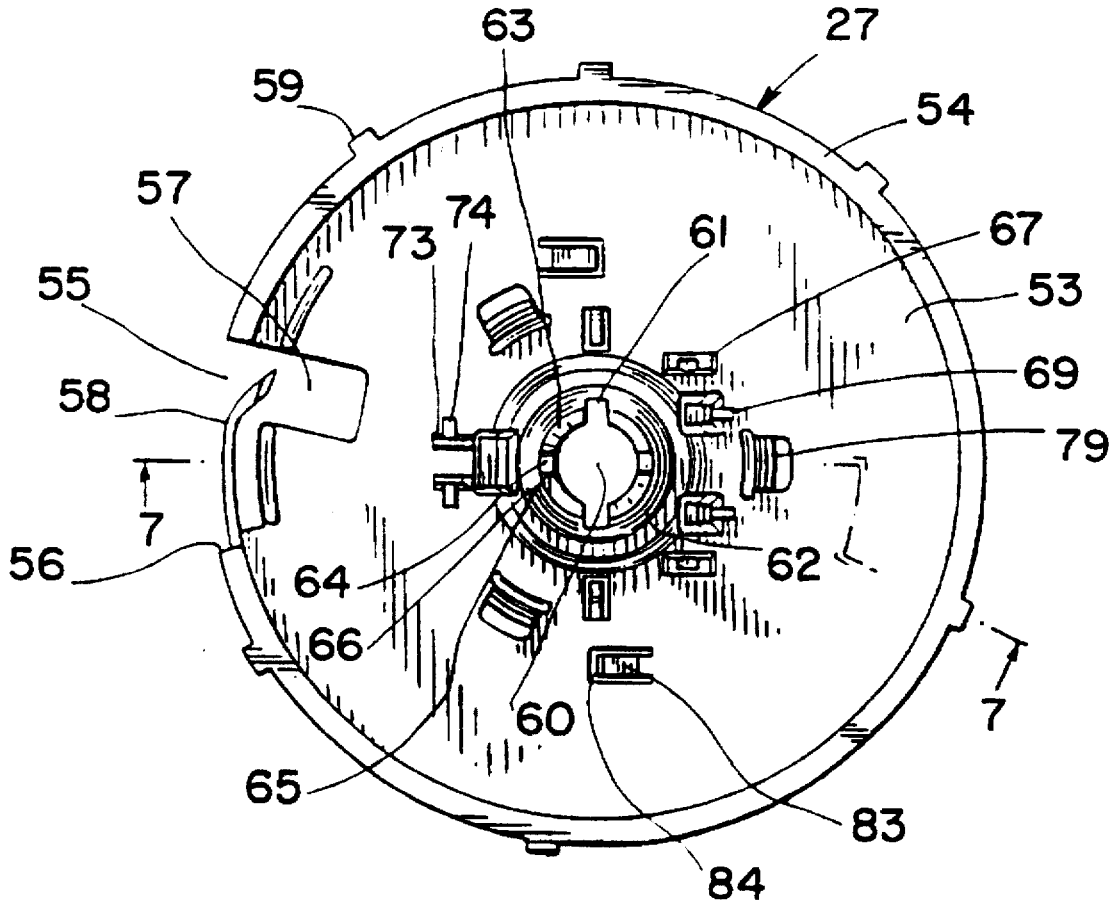
FIG. 6 is a top plan view of a base component illustrated in FIG. 3.
Figure 7:
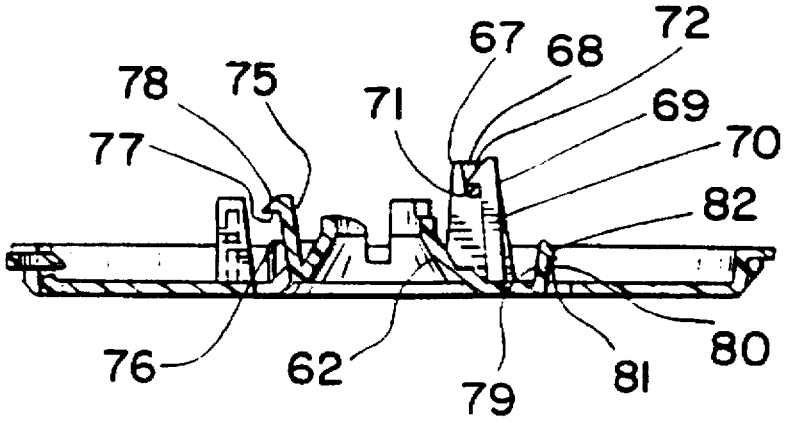
FIG. 7 is a sectional view of the base taken across lines 7—7 of FIG. 6.

FIGS. 6 and 7 illustrate the preferred embodiment of the base 27 which serves, among other functions, to fixture the operating componetry. The base 27 is fabricated from a material, such as a plastic, and contains some rigid members, and other flexible ones, depending upon the mass of the member. As shown in FIG. 6, the essentially circular base 27 comprises a flat platform 53, a periphery wall 54 and a vertical axis-of-rotation located in the center. The girth of the base is such that the periphery wail 54 circumscribes the pill container 29 when assembled thereto. The periphery wall 54 is interrupted by a slot 55 which defines a counterclockwise edge 56 to the periphery wall 54. A pill exit aperture 57 in the flat platform 53, defining a front half to the flat platform, is located contiguous with the slot 55 and serves to release a pill rotated thereunto from containment in the pill container 29. A spring finger 58 extends from the counterclockwise edge 56 of the periphery wall 54 into the space above the pill exit aperture 57. When the pill container 29 is initially assembled to the base 27, the spring finger 58 is interposed through the last pill slot 36 into the interior space of the last pill cell 35 serving to suspend the last pill therein above the pill exit aperture 57. The spring finger 58 is angled to cooperate with the angled surface 37 of the pill container 29 in withdrawal of the spring finger 58 from the last pill cell 35 by flexing it outwardly during a first clockwise rotation of the pill container relative to the base. The degree of penetration provided by the length and angle of the spring finger 58 is such that contact with the last pill is maintained long enough during the rotation to transition the last pill safely into an inclosed position beyond the pill exit aperture 57 where the flat platform 53 covers the open bottom of the last pill cell 35. A plurality of orienting tabs 59 extend radially outward from the periphery wall 54. In this particular embodiment, the orienting tabs 59 are arrayed asymmetrically so as to provide a unique orientation of the base 27 to an enveloping structure, (not shown) having complementary geometries receiving the orienting tabs.

Referring to FIG. 6, a connector-receiving aperture 60 is located in the center of the flat platform 53, and is circular with two keyways 61 branching oppositely. A center wall 62 surrounding the connector-receiving aperture 60 and the keyways 61 rises vertically from the flat platform 53. The lower portion of the center wall 62 flares outwardly while the upper portion is straight-sided. This is best viewed in FIG. 7. The upper portion of the center wall 62 is partially cut-away adjacent to each keyway 61 to form a spiraling ramp 63. The spiraling ramp 63 rises from the keyway 61 in the sense of, and through the span of, a right-hand quarter turn to arrive at a notch 64 positioned at an interim elevation. The notch 64 is bordered by the standing quarter of the upper portion of the center wall 62 comprising an abutting edge 65. The abutting edge 65 in the front half of the flat platform 53 is cut away to provide a level surface 66 next to the notch 64. The geometries and features of the connector-receiving aperture 60 and the center wall 62 described herein are designed to cooperate with elements of the plunger 30 and the plug connector 27. A full functional description, therefore, will await a detailed recitation of these elements.

Referring again to FIG. 6, it can be shown that two cradle struts 67 are positioned in the back half of the flat platform 53 to which they are attached. The cradle struts 67 end in cradle recesses 68 which face oppositely and define therebetween a horizontal axis-of-rotation at an elevation above the flat platform 53. In this particular embodiment, the horizontal axis-of-rotation is positioned so that a perpendicular line midway between the cradle struts 67 also intersects the vertical axis-of-rotation in a plane parallel to the flat platform 53 and forms an angle with a coplanar centerline of the pill exit aperture 57 passing through the common intersection point at the vertical axis-of-rotation defined as the quotient of 360 degrees and the number of pills in the regimen. An elevation view of the cradle strut 67 and the cradle recess 68 can be seen in FIG. 7. Continuing with FIG. 7, it can be shown that the cradle strut 67 flares to form a rigid base providing particular rigidity in a direction perpendicular to the horizontal axis-of-rotation. This particular rigidity combined with a lateral spread between the cradle struts 67 contributes torsional stability to the horizontal axis-of-rotation. One or more cradle-retaining latches 69 are positioned between the cradle struts 67 and aligned parallel to the horizontal axis-of-rotation. There are two cradle-retaining latches 69 in the particular embodiment shown in FIG. 6. Each cradle-retaining latch 69 is comprised of a cradle-retaining latch arm 70, a cradle-retaining latch notch 71 and a cradle-retaining latch sliding face 72. From its point of attachment to the flat platform 53, the cradle-retaining latch arm 70 flexibly supports the cradle-retaining latch notch 71 which is elevated to overhang, and thereby rotatably capture, a bar-like feature, not presently recited, when seated in the cradle recesses 68. The cradle-retaining latch sliding face 72, positioned on top of the cradle retaining latch 69, is angled so as to flex the cradle-retaining latch 69 openly when an object is pressed downwardly thereupon during bypass.

As shown in FIG. 6, two upright parallel beam springs 73 are attached to the front half of the flat platform 53 and are positioned to straddle the perpendicular bisector of the horizontal axis-of-rotation. The parallel beam springs 73 are provided with spring buttresses 74 along the outside longitudinal surfaces to stiffen the degree of flexure of springs 73. The height of the buttresses and the various tapers of the beams can be adjusted to provide a specific force against a spreading object forced downwardly between the ends of the parallel beam springs 73. A wedge-retaining latch 75 is positioned next to the parallel beam springs 73 in a space between the parallel beam springs 73 and the center wall 62 transversed by the perpendicular bisector of the horizontal axis-of-rotation. Similar to the cradle-retaining latch 69 before, and best viewed in FIG. 7, the wedge-retaining latch 75 is comprised of a wedge-retaining latch arm 76, a wedge-retaining latch notch 77 and a wedge-retaining latch sliding face 78. The wedge-retaining latch arm 76 which is attached to the flat platform 53 provides a flexible support for the wedge-retaining latch notch 77. The elevation of the wedge-retaining latch notch 77 provides sufficient clearance above the flat platform 53 to accommodate the sweep of a feature initially positioned in engagement with the notch and pivoting from the horizontal axis-of-rotation downward in an arc. The wedge-retaining latch arm 76 has sufficient clearance to avoid interference from its path of rotation. The wedge-retaining latch sliding face 78 is positioned on top of the wedge-retaining latch 75 and is angled so as to flex the wedge-retaining latch 75 openly when an object is pressed downwardly thereunto during bypass.

Figure 19:
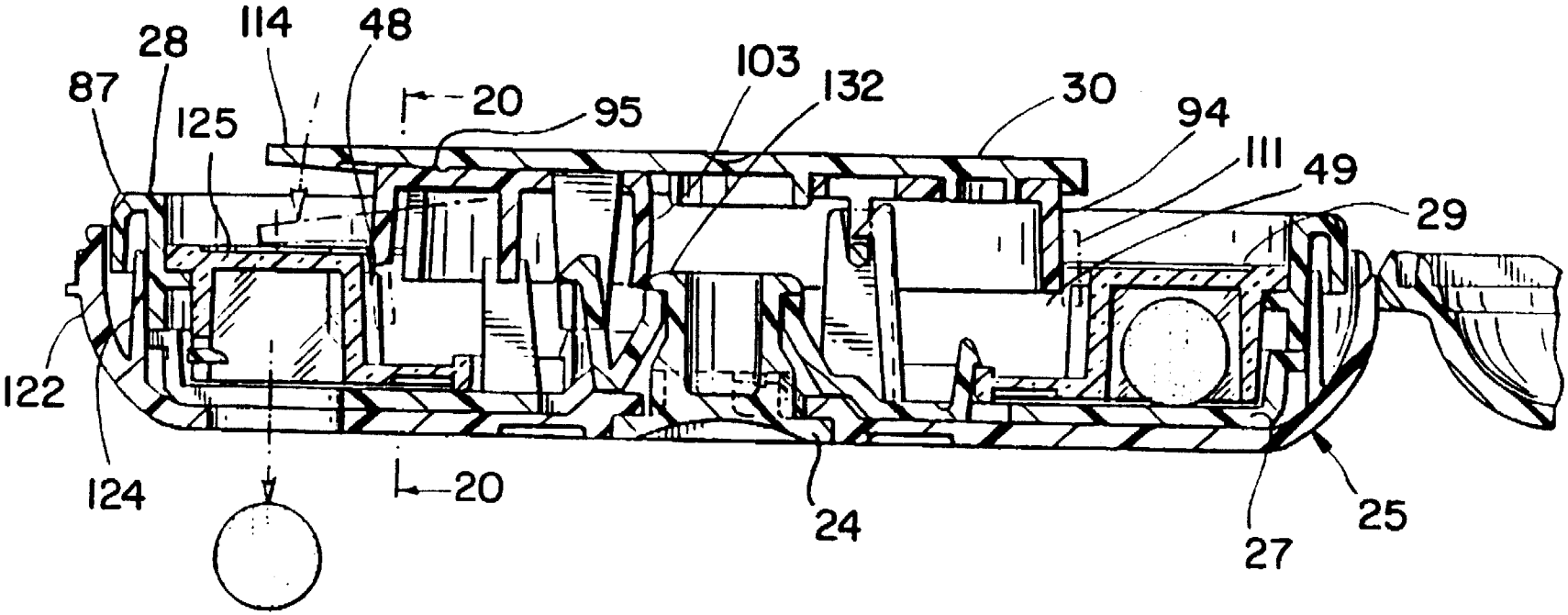
FIG. 19 is a sectional view of the dispenser taken across lines 19—19 of FIG. 1.

A plurality of hold down hooks 79 are arrayed about the vertical axis-of-rotation. (There are three such hold down hooks 79 in the embodiment shown in FIG. 6.) The circle has a diameter of sufficient dimension to inscribe the rim 42 of the pill container 29 and circumscribe the parallel beam springs 73, the cradle struts 67 and the cradle retaining latches 69. It can be seen from FIG. 7, and deduced from the description below, that the hold down hooks 79 have features similar to the cradle-retaining latches 69 and the wedge retaining latch 75 and, therefore, perform similar functions in a similar manner. Each hold down hook 79 comprises a hold down hook arm 80, hold down hook notch 81 and a hold down hook sliding face 82. The hold down hook arm 80 flexibly supports the hold down hook notch 81 from a point of attachment to the flat platform 53. The hold down hook notch 81 is oriented in such a fashion, and has a sufficient elevation, to overlap the rim 42 of the pill container 29 forming a rotatable connection therewith. FIG. 19 shows a sectional view of the assembly. The hold down hook sliding face 82 is positioned on top of the hold down hook 79 and is angled to flex the hold down hook 79 openly when the pill container 29 is pressed downwardly thereunto.

One or more ratchet springs 83, forming the part of the ratchet mechanism complementary to the ratchet track 45, are arrayed about a circle centered at the vertical axis-of-rotation and having a diameter equal to that of the ratchet track 45. While any number of ratchet springs 83, up to the count of the number of pills in the regimen, is theoretically possible, the system works best with either one or two such ratchet springs 83. This minimizes the coordination required for the ratchet springs 83 to act in unison and reduces drag upon the rotating member. In the particular embodiment shown in FIG. 6, the two ratchet springs 83 are spaced equidistantly conveying the implication that there are an even number of pills in the regimen. Each ratchet spring 83 is attached to the flat platform 53 and inclined thereto, in the sense of clockwise rotation, to resiliently respond to a downward force provided by interaction with the track ramps 46. Each ratchet spring 83 terminates in a ratchet pawl 84 for engagement therewith to the track ramps 46 and vertical stops 47 of the ratchet track 45. The ratchet pawls 84 are aligned radially and spaced integrally to coordinate with the vertical stops 47. An index position is defined by the seating of the ratchet pawls 84 in the detents of the ratchet track 45. The positioning of the ratchet pawls 84 about the circle is such that each index position corresponds to an alignment of one of the pill cells 31 with the pill exit aperture 57.

Periodicity Indicator Ring

Figure 8:
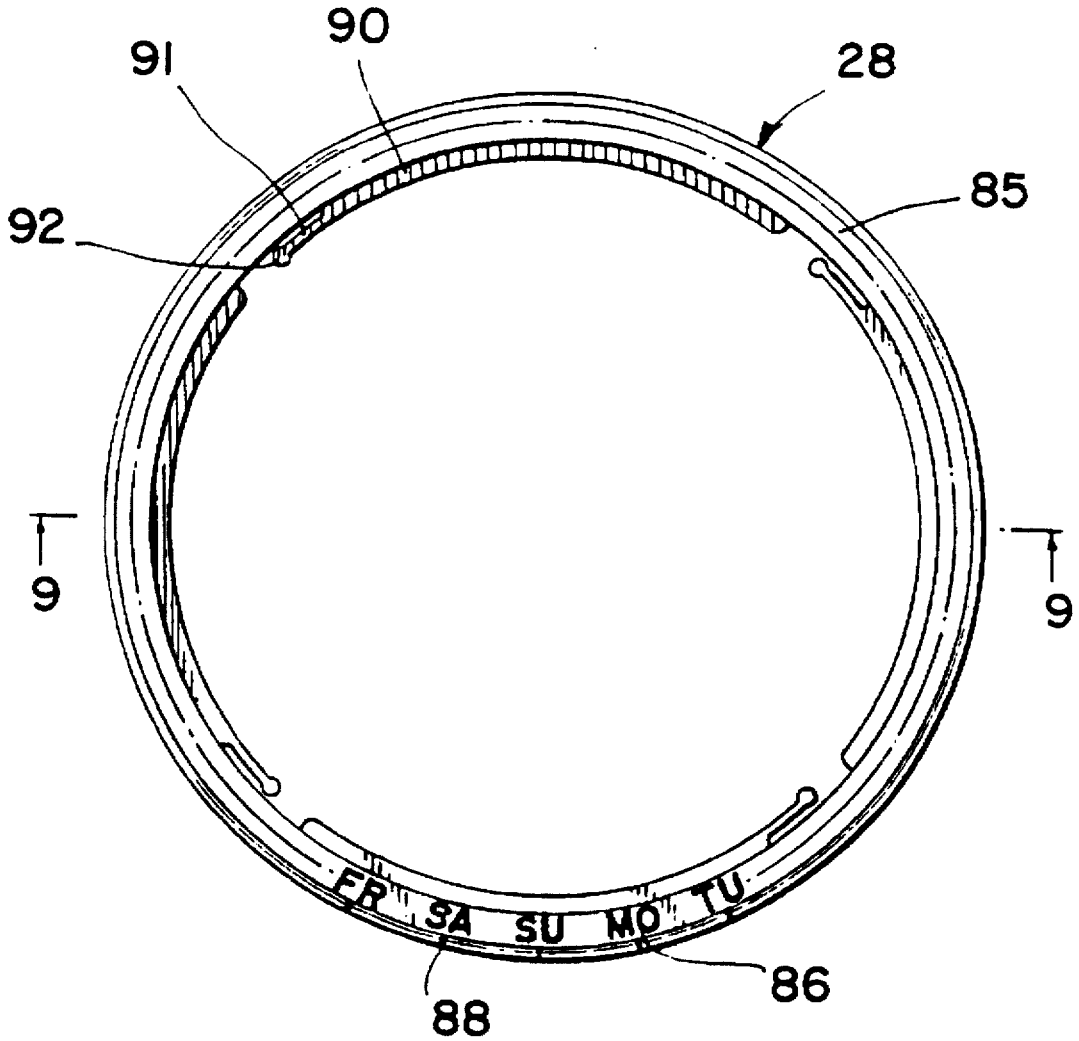
FIG. 8 is a top plan view of a periodicity indicator ring component illustrated in FIG. 3.
Figure 9:
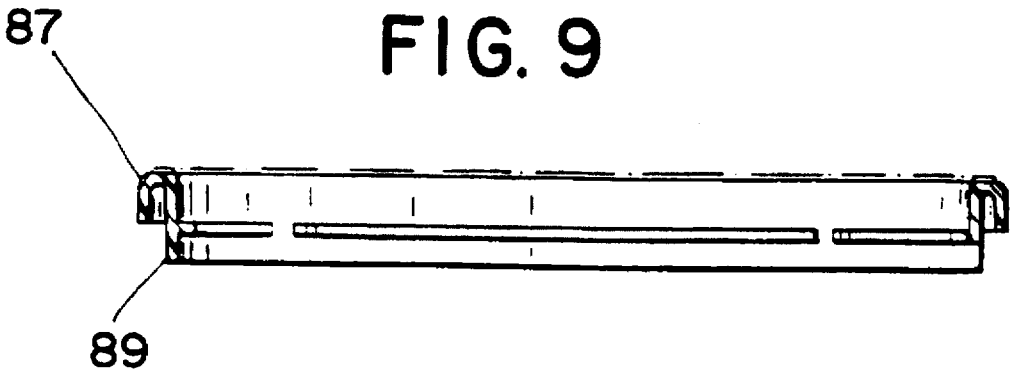
FIG. 9 is a sectional view taken across lines 9—9 of FIG. 8.

FIGS. 8 and 9 illustrate the preferred embodiment of the periodicity indicator ring 28 which serves to changeably label the regimen of pills. This component is also fabricated from a material, such as a plastic, which has the property of being both rigid and flexible depending upon the mass of the member. As shown in FIG. 8, the circular periodicity indicator ring 28 is comprised of a ring top surface 85 upon which indicators of periodicity 86 are imprinted or engraved. The indicators of periodicity 86 are arrayed around the ring top surface 85 in such a number and interval that a one-to-one correspondence is established with the pill cells 31 of the pill container 29 when assembled therewith. The indicators of periodicity 86 can be any letter, number or icon, or any combination or mixture thereof, which indicates the timing for the administration of any specific pill of the regimen, or otherwise indicates the progress of such administration. The set of indicators define a period, or a multiplicity of periods, so that any start point cycles back upon itself. Thus the start point can be varied as appropriate for the specific regimen and circumstances. In this embodiment, the indicators of periodicity 86 are days-of-the-week. A chamfered surface 87 angles downwardly and outwardly away from the outer edge of the ring top surface 85 providing both a cosmetic finish and a location for a hand grip. In the embodiment shown, knurls 88 are provided to assist a user's grip.

A ring wall 89 is joined to the ring top surface 85 at the inside edge and extends downwardly to ride upon the top edge of the periphery wall 54 of the base 27 when assembled thereto, as best shown in FIG. 9. Referring back to FIG. 8, a particular plurality of segmented ledges 90 are attached to the ring wall 89 at a partial elevation thereof and extend laterally inward. The diameters are such that, when assembled with the pill container 29, the ring wall 89 surrounds the bezel 39 and the segmented ledges 90 surround the outer wall 33, the bezel 39 overlapping the segmented ledges 90 thereby trapping the periodicity indicator ring 28 between the pill container 29 and the base 27 when stacked in assembly. This assembly stack is best observed in the sectional view of FIG. 19. The length of the portion of the ring wall 89 below the segmented ledges 90 is defined by the elevation of the bezel 39 above the periphery wall 54 with allowance for clearance to rotate the periodicity indicator ring 28. The length of the remainder of the ring wall 89 is determined by the desired height of the ring top surface 85 relative to the top surface 34 of the pill container 29. In this embodiment, the ring top surface 85 is at a higher level to facilitate manipulation of the periodicity indicator ring 28.

Referring to FIG. 8, it can be seen that tangential springs 91 are formed by slotting one end of the segmented ledges 90. Each tangential spring 91 ends in a rounded pawl 92 which is provided an inward bias by the flexibility of the tangential spring 91 and room to deflect outwardly by position away from the ring wall 89. The rounded pawls 92 are arrayed such that they simultaneously seat to the vertical channels 38 of the pill container 29 defining therein an index position. The plurality of the rounded pawls 92, and consequently of the segmented ledges 90, ranges from a minimum of three to a maximum that space will allow up to the number of pills in the regimen. At least three points of contact with the pill container in opposition are needed to suspend the periodicity indicator ring 28 circumferentially. In this particular embodiment, four rounded pawls 92 are evenly spaced, conveying the implication that the number of pills in the regimen is divisible by four. The rounded pawls 92 are oriented to the indicators of periodicity 86 such that alignment with pill cells 31 results.

The symmetry of the contour of the rounded pawl 92, as best viewed in FIG. 8, and the complementary contour of the vertical channel 38, as best viewed in FIG. 10, allow for the equilateral rotation of the periodicity indicator ring 28 about the pill container 29 to achieve a setting. As will be explained hereinafter, the pill container 29 is normally held stationarily, unless activated to dispense pills, so that rotation is accomplished by gripping the periodicity indicator ring 28 and turning. The initial setting labels the first pill of the regimen, and each sequential pill in turn, with an indicator of periodicity 86 appropriate for the particular regimen under administration. The setting remains constant with the rotation of the pill container 29 but the indicator of periodicity 86 changes with each dispensation relative to a fixed point of registration.

Plunger Component

Figure 12:
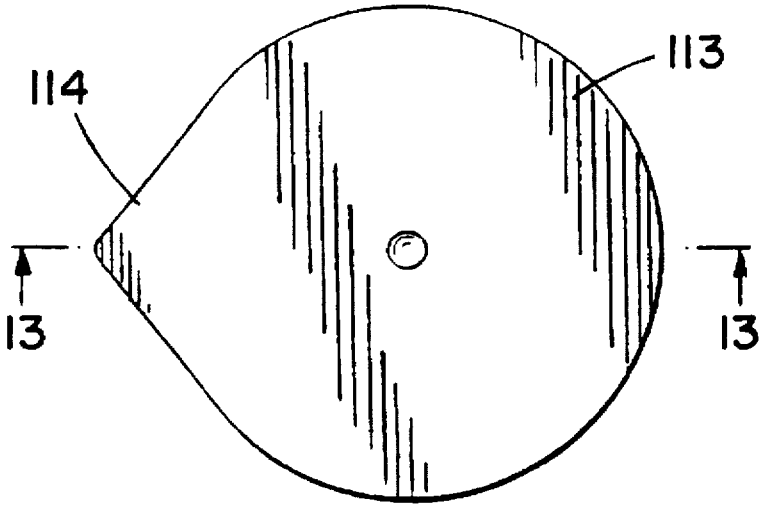
FIG. 12 is a top plan view of a plunger component illustrated in FIG. 3.
Figure 13:
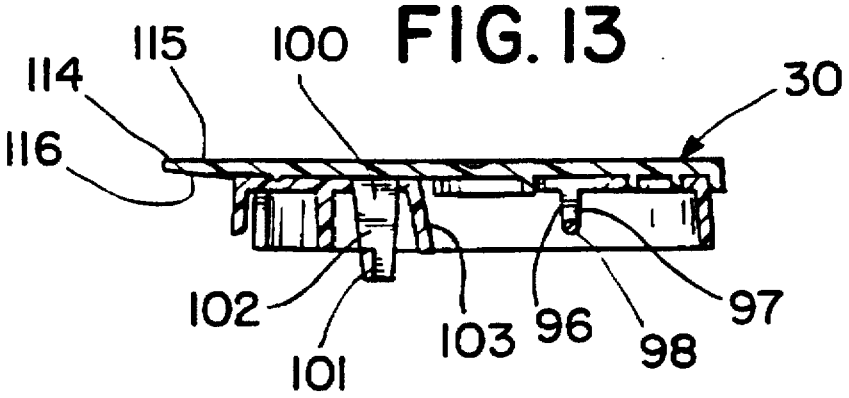
FIG. 13 is a sectional view of the plunger taken across lines 13—13 of FIG. 12.
Figure 14:
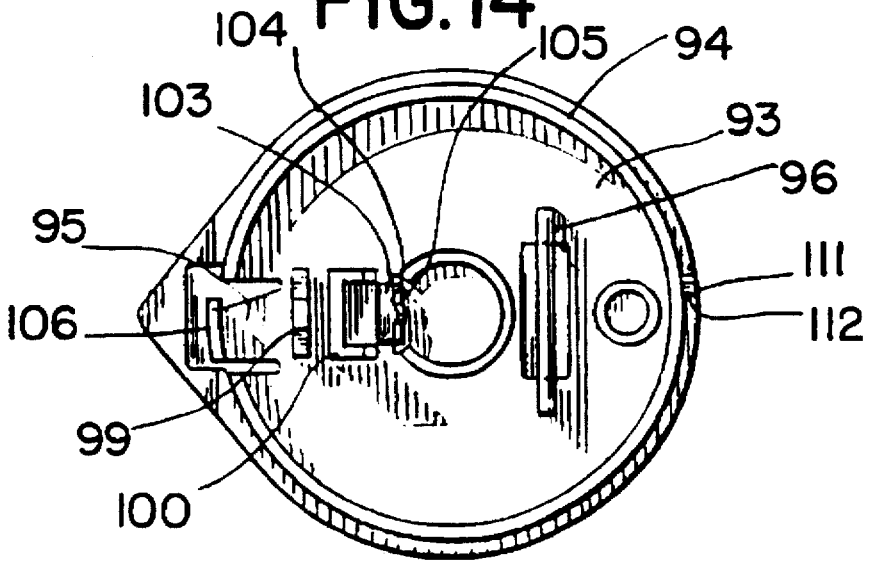
FIG. 14 is a bottom plan view of the plunger of FIG. 12.

FIGS. 12, 13, and 14 illustrate the preferred embodiment of the plunger 30 which serves, among other functions, to provide a cyclical driving force to the pill container 29. This component is also fabricated from a material, such as a plastic, which is either rigid or flexible depending upon the mass of the member. As shown in FIG. 14, the plunger 30 comprises a plunger base 93 surrounded by a cylindrical wall 94 having a diameter dimension slightly smaller than the bore 49 of the pill container 29. A slotted extension 95 protrudes through the cylindrical wall 94 which is discontinuous at that point defining a front half to the plunger base 93. A pivot 96 positioned in the back half of the plunger base 93 comprises two rigid pivot support arms 97 attached perpendicularly to the plunger base 93 and bridged at the ends by a horizontal pivot bar 98. The horizontal pivot bar 98 has a round cross-section, best viewed in FIG. 13. The pivot 96 is sized and located to pivotally seat within the cradle recesses 68 while the horizontal pivot bar 98 underlaps the cradle retaining latch notches 71 when assembled to the base 27.

As viewed in FIG. 14, a spreading wedge 99 is attached to the front half of the plunger base 93 and positioned to spread the parallel beam springs 73 of the base 27 apart when assembled thereto and motivated by a downward pivoting force applied to plunger 30. Thus a potential is created in the parallel beam springs 73 for a reciprocating force acting upwardly by compression against the convergent sides of the spreading wedge 99. The reciprocating force automatically returns the plunger 30 to a rest position where the spreading wedge 99 is cradled in the mouth of the parallel beam springs 73 thereby completing the stroke cycle. The length of the pivot support arms 97, as shown in FIG. 13, is such that the plunger 30 is level in the rest position. Continuing with FIG. 13, it can be shown that a wedge stop 100 is attached to the plunger base 93 and is positioned to interface with the wedge-retaining latch 75 of the base when assembled thereto. The wedge stop 100 comprises a horizontal stop bar 101 which is positioned vertically to underlap the wedge-retaining latch notch 77 in the rest position thereby limiting upward pivotal travel of the plunger 30. A longitudinal slot 102 is provided above the stop bar 101 for free travel of the wedge-retaining latch notch 77 interposed in the longitudinal slot 102 as necessitated by the downward rotation of the overhead structure.

A plunger lock 103 is located rearward of the wedge stop 100 and is positioned to interface with the level surface 66 of the center wall 62 of the base 27 when assembled thereto. As viewed in FIG. 14, the plunger lock 103 is comprised of a flexible beam 104 attached to the plunger base 93 which ends in a lock abutting face 105. The flexible beam 104 is angled inwardly and downwardly toward the center wall 62 and spans the distance to abut the level surface 66 with the lock abutting face 105 when the plunger 30 is in the rest position. This serves the purpose of buttressing the plunger 30 against inadvertent pivoting, which might result in the accidental expression of a pill, except when the flexible beam 104 is deflected laterally by a device not yet recited. It can be seen in FIG. 14 that the spreading wedge 99, the wedge stop 100, the plunger lock 103, and the pivot 96 are all collinear with the center of the plunger base 93 and the slotted extension 95. Reference to the sectional elevation view of FIG. 19, which illustrates the assembly, shows that positioning along the common line is such that the cylindrical wall 94 fits within the bore 49 of the pill container 29 with the slotted extension 95 overhanging the saw teeth 48. This view also illustrates the interposition of the corresponding parts of the plunger 30 and the base 27 postured in the rest position.

Referring back to FIG. 14, it can be seen that a sliding shoe 106 is attached to the end of the slotted extension 95 from which it is pendant. The partial sectional views of FIG. 20 best illustrate the detail which hereto follows. The sliding shoe 106 comprises a flexible arm 107 and an angled extension 108 which elongates the flexible arm 107 in a clockwise sense. The distal end of the angled extension 108 fails along the common line of the plunger 30 and is positioned directly over the distal end of one of the saw teeth 48 of the pill container 29 when assembled thereto. The extended flexible arm 107 has a downward-exposed sliding face 109. The sliding face 109 has a tilt and incline complementary to the ramp face 50 of the saw tooth 48 such that the sliding face 109 moving downward against the ramp face 50 during the pivoting stroke causes the contacting faces to interlock while simultaneously sliding oppositely along the incline thus imparting a torque to the pill container 29. The torque causes a rotational movement of the pill container 29 with respect to the base 27 and plunger 30 thereby advancing a pill cell 31 over the pill exit aperture 57 resulting in the release of the pill contained therein. In the case of the first rotational movement, the suspended last pill is also transported past the pill exit aperture 57. The angled extension 108 of the flexible arm 107 is driven into the intervening space between the operative saw tooth 48 and the next advancing saw tooth by the finish of the pivot stroke, The angled extension 108 has an upward exposed bypassing face 110 with a bevel complementary to that of the overlap face 51 of the saw tooth 48 such that the composite structure of the flexible arm 107 and the slotted extension 95 is flexed inward when the bypassing face 110 moves upward against the overlap face 51, sliding oppositely along the beveled surfaces to transition over the thickness of the next advancing saw tooth 48, under the propulsion of the reciprocating force of the parallel beam springs 73. The transition ends with the reposturing of the sliding shoe 106 above the next advancing saw tooth 48 thereby completing a stroke cycle and an index of the pill container 29.

Referring to FIG. 14, it can be shown that a limit bar 111 extends outward from the cylindrical wall 94 in a location diametrically opposite to the sliding shoe 106 into the intervening space between the cylindrical wall 94 and the inner wall 32 of the pill container 29 when assembled thereto. The extent of the limit bar 111 is such that a vertical face 112 of the limit bar 111 is positioned in proximal contact with the saw tooth abutting face 52 nearest the pill cell representing the median point of the regimen. The vertical positioning of the limit bar 111 is such that interposition of the vertical face 112 and the saw tooth abutting face 52 occurs only when the plunger 30 is in the rest position thereby preventing the gratuitous clockwise advance of the pill container 29. It will be recalled that the counterclockwise movement of the pill container is limited by the ratchet mechanism. Therefore, pill container movement is effectively locked by combination of these two devices which serve to prevent accidental discharge of the pills. When the plunger 30 is pivoted, the limit bar 111 rotates into a clearance position with respect to the saw tooth abutting face 52 thereby allowing advancement of the pill container 29. FIG. 19 shows the limit bar 111 (in phantom).

A cover 113 can be attached to the top surface of the plunger base 93 as a cosmetic device. In the specific embodiment shown in FIG. 12, the cover 113 comprises a pointer protrusion 114 which extends over the slotted extension 95 in an orientation to the operative pill cell 31, and the corresponding indicator of periodicity 86, thereby serving as a fixed reference point for indicating. The pointer protrusion comprises a pointer top surface 115 and a pointer bottom surface 116, as viewed in FIG. 13. The pointer top surface 115 can function as a finger pressure location to apply pivoting force to the plunger 30. The pointer top surface 115 can also be labeled with an instruction, such as "push", to facilitate the preferred technique for operating. The pointer bottom surface 116 can serve to prevent overextension of the pivot stroke by contact with the top surface 34 of the pill container 29. The precise pivot stroke can therefore be defined as a combination of the incline of the saw teeth, the pill cell spacing, and the elevation of the pointer bottom surface. The movement of the pointer protrusion 114 can be seen in phantom in FIG. 19. The cover 113 can be attached to the plunger by any fastening means such as glue or sonic welding. Care is taken to avoid any attachment above the slotted extension which would limit the articulation of this feature.

Hinged Shell Component

Figure 4:
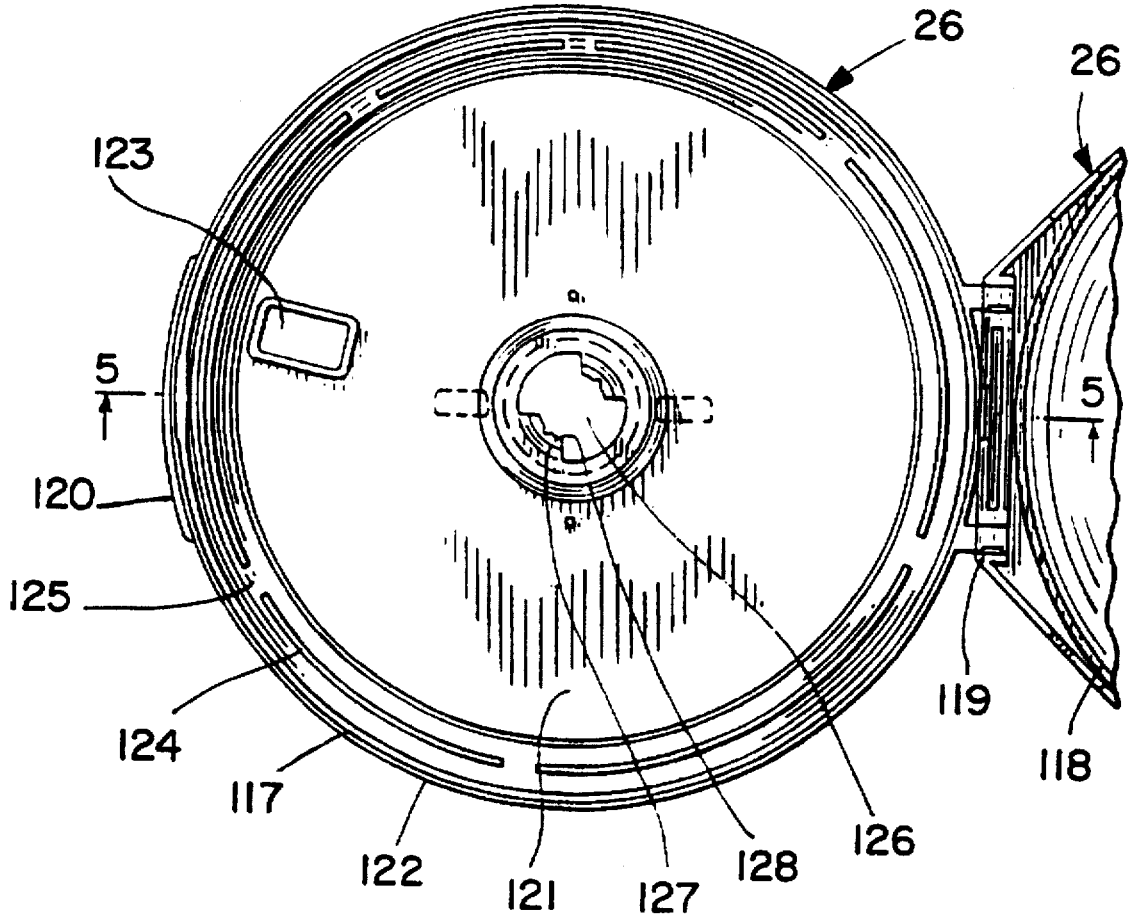
FIG. 4 is a top plan view of a hinged shell component illustrated in FIG. 3.
Figure 5:
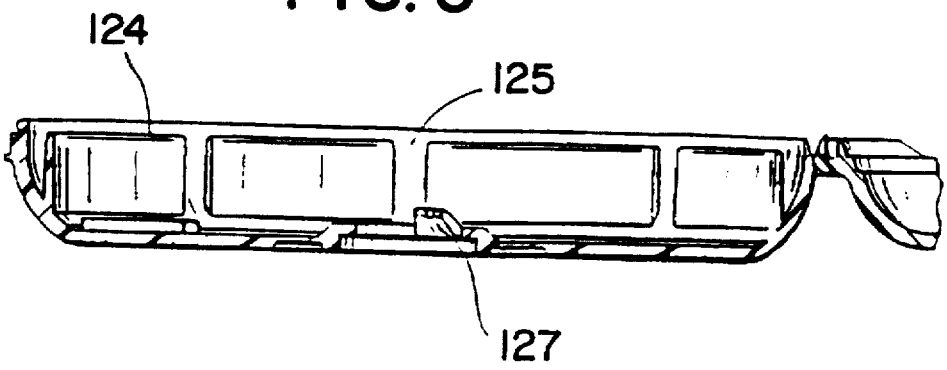
FIG. 5 is sectional view of the hinged shell taken across lines 5-5 of FIG. 4.

FIGS. 4 and 5 illustrate the preferred embodiment of the hinged shell 26 which serves to inclose and protect the subassembly containing the pills. This component is fabricated from any material, such as a plastic, having the properties of stiffness and, in the case of light degradation, opacity. The hinged shell 26 is comprised of a bottom element 117 and a top element 118 connected by a hinge mechanism 119 and closed by a latch mechanism 120. Both such mechanisms are in common use in the mechanical arts and any of a variety of designs are suitable. The hinged shell 26 is configured and sized to wholly contain the subassembly of the base 27, pill container 29, periodicity indicator ring 28 and plunger 30, the subassembly constituting a refill unit when loaded with a regimen of pills. Referring to FIG. 4, it can be seen that the bottom element 117 comprises a floor surface 121 and an encircling wall 122. A pill release aperture 123 in the floor surface 121 is positioned to align with the pill exit aperture 57 of the base 27 when the refill is properly oriented thereby providing a conduit for the pills. A circular fixturing wall 124, having sufficient diameter to circumscribe the ring wall 89 of the periodicity indicator ring 28, is attached to the bottom element 117 inboard of the encircling wall 122 and rises to an interim elevation of the ring wall 89 when assembled thereto. The fixturing wall 124 is segmented by fixturing wall slots 125 wide enough to pass the orienting tabs 59 of the base 27. The elevation detail can be seen in FIG. 5. Referring back to FIG. 4, the fixturing wall slots 125 are arrayed to correspond with the orienting tabs 59 and have an orientation to the floor surface 121 such that the pill release aperture 123 and the pill exit aperture 57 are in alignment when the base 27 is fixtured by extension of the orienting tabs 59 through the fixturing wall slots 125. In this embodiment, as shown in FIG. 19, the space between the encircling wall 122 and the fixturing wall 124 is cosmetically covered by the chamfered surface 87 of the periodicity indicator ring 28.

A connector-fixturing aperture 126 in the floor surface 121 is located so as to align with the connector-receiving aperture 60 of the base 27 when assembled thereto, best viewed in FIG. 4. In this embodiment, the connector-fixturing aperture 126 is circular with a minimum diameter equal to the span the keyways 61 of the base 27. The connector-fixturing aperture 126 is rimmed by a plurality of flexible retaining struts 127 connected to the floor surface 121. In this embodiment, there are two retaining struts 127 arranged to clasp a circular object bilaterally between retaining strut ends 128. The retaining strut ends 128 provide a narrowing of the aperture at a uniform elevation above the floor surface 121 by an inwardly and upwardly span of the retaining struts 127. The retaining strut structures are sufficiently compact to fit within the flared portion of the center wall 62 of the base 27. The connector-fixturing aperture 126 and the retaining struts 127 described herein are designed to cooperate with elements of the plug connector 24. A full functional description, therefore, will follow a recitation of the plug connector 24.

Figure 15:
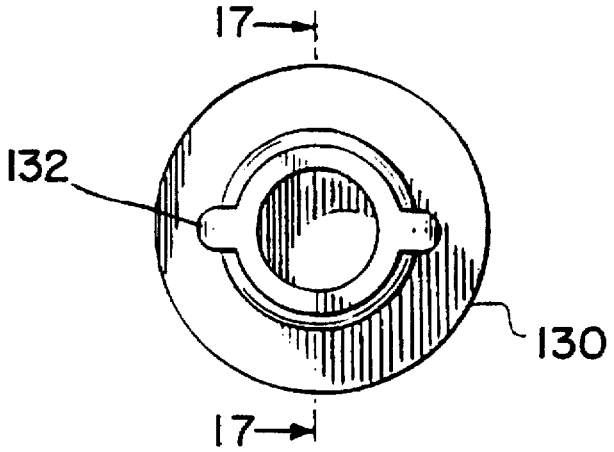
FIG. 15 is a top plan view of a plug connector component illustrated in FIG. 3.
Figure 16:
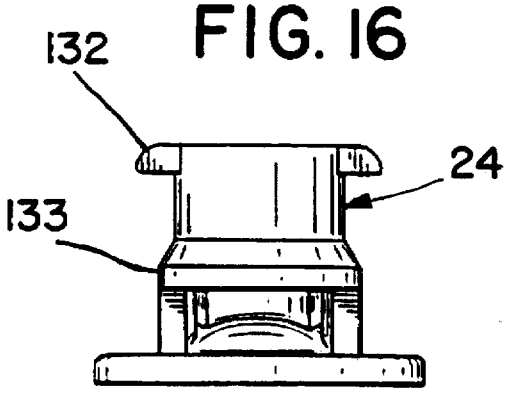
FIG. 16 is a side elevation view of the plug connector of FIG. 15.
Figure 17:
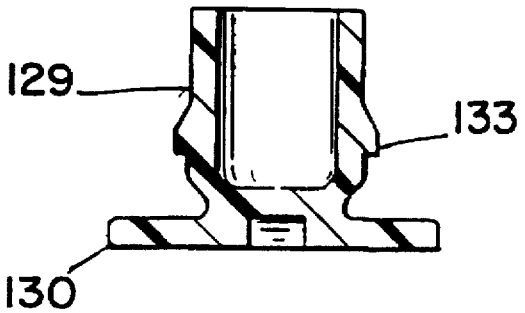
FIG. 17 is a sectional view of the plug connector taken across lines 17—17 of FIG. 15.
Figure 18:
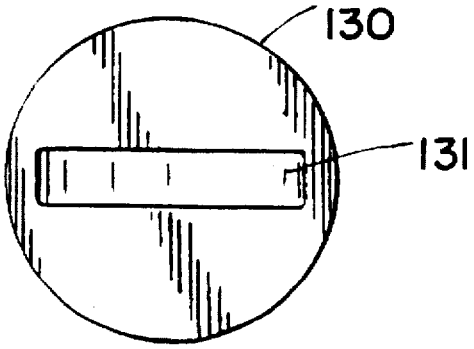
FIG. 18 is a bottom plan view of the plug connector of FIG. 15.

Plug Connector Component: FIGS. 15, 16, 17 and 18 illustrate the preferred embodiment of the plug connector 24 which serves, among other functions, to removably lock the refill unit into the hinged shell 26. This component is fabricated from any material, such as a plastic, having the property of toughness. Referring to FIGS. 16 and 17, the plug connector 24 is comprised of a tubular body 129 having a diameter smaller than the connector-receiving aperture 60 of the base 27 thereby permitting penetration through both the connector-fixturing aperture 126 of the bottom element 117 of the hinged shell 26 and the connector-receiving aperture 60. The plug connector 24 is further comprised of a circular base flange 130 connected at one end of the tubular body 129. The diameter of the base flange 130 is greater than that of the connector fixturing aperture 126 so that penetration of the tubular body 129 is limited by contact of the base flange 130 with the bottom element 117. Plan views of the base flange 130 can be observed in FIGS. 15 and 18. Referring to FIG. 18, it can be shown that the base flange 130 has a tool slot 131 in the bottom surface for inserting a tool, such as a coin, therewith to twist the plug connector 24.

The tubular body 129 has two key tabs 132 attached at the other end which are configured and sized to fit through the keyways 61 and which have a lateral extent sufficient to overlap the spiraling ramps 63 and notches 64 of the center wall 62 of the base 27 when assembled thereto. FIGS. 15 and 16 show the key tabs 132 in plan and elevation views, respectively, The height of the tubular body 129 is such that the key tabs 132 clear the bottom of the spiraling ramps 63 with modest tolerance in the stacked assembly of the hinged shell 26 and base 27 with the tubular body 129 interpenetrating the aligned apertures and the base flange 130 in contact with the bottom element 117. When the plug connector 24 is twisted one-quarter turn clockwise by inserting a tool in the tool slot 131 and levering, the key tabs 132 ride up over the spiraling ramps 63 to seat in the notches 64 thereby removing the tolerance and snugly locking the stacked assembly together. The key tab 132 rotating into the front half of the base 27 simultaneously urges the plunger lock 103 out of its seat across the path of travel thereby freeing the plunger 30 by deflecting the plunger lock 103 to ride upon the outside of the center wall 62. As a consequence of this safety device, pills cannot be dispensed until loaded into the hinged shell 26. The flared portion of the center wall 62 progressively increases the flex of the flexible beam 104 thereby supplementing the reciprocal force of the parallel beam springs 73. The plunger lock 103 is shown in the deflected position with the plunger 30 at rest in FIG. 19.

The tubular body 129 also has an attached locking ring 133, shown in FIGS. 16 and 17, with a saucer-like, lateral extent smaller than that of the connector fixturing aperture 126 and larger than that of the circle circumscribed by the retaining struts 127 of the hinged shell 26. The elevation of the locking ring 133 is such that an overlap of the retaining strut ends 128 is established when the plug connector 24 is fully inserted into the bottom element 117 and the locking ring 133 is forced into bypass by flexing the retaining struts 127 outwardly. This overlap serves to rotatably connect the plug connector 24 permanently to the hinged shell 26 thereby simplifying loading and removal of the refill unit.

Figure 2:
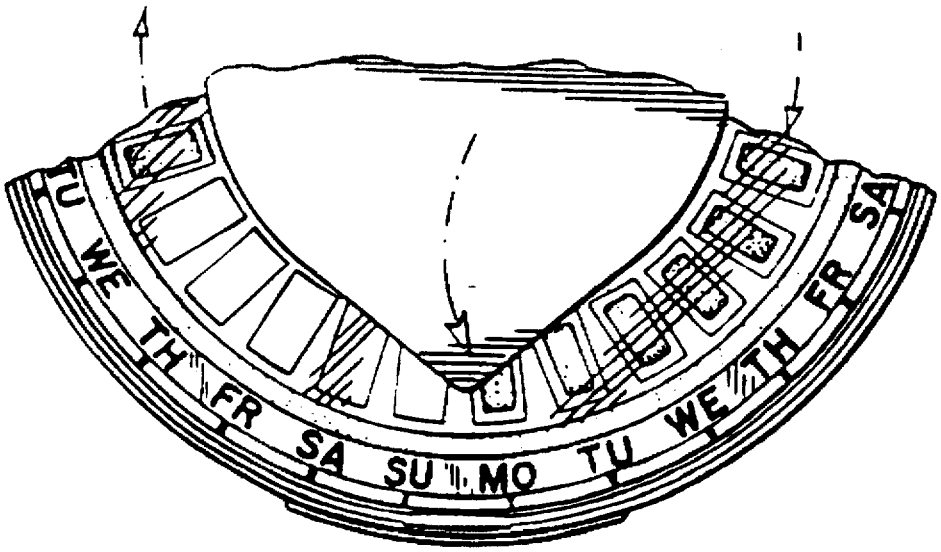
FIG. 2 is a partial top plan view of the dispenser of FIG. 1 showing simultaneous actuation movements.

The dispenser 25 of the present invention is normally supplied fully assembled and filled with pills. FIG. 1 shows the dispenser 25 opened and ready for use. The user first sets the starting indicator by gripping the chamfered surface 87 of the periodicity indicator ring 28 and turning the periodicity indicator ring 28 either right or left until an appropriate indicator of periodicity 86 is aligned with the pointer protrusion 114 of the plunger 30. In the example illustrated in FIG. 2, the starting day was set for Wednesday. The current day, the dispensing day, can be identified as Monday because it aligns with the pointer protrusion 114 and because it represents the advancing boundary between filled and untilled pill cells 31. There can be several methods for the step of dispensing the pill. The preferred method is for the user to hold the opened dispenser 25 in one hand with the thumb positioned over the pointer protrusion 114 while the palm is cupped beneath the pill release aperture 123 of the hinged shell 26, which is supported by the fingers. The thumb is pressed downward against the pointer protrusion 114 by a clamping action of the hand resulting in the plunger 30 pivoting and the pill container 29 rotating. A pill is dropped into the cupped palm when the pill container 29 advances one index position to cover the pill exit aperture 57 with the operative pill cell 31. The dispensing procedure is repeated at each time indicated on the periodicity indicator ring 28 until all of the pills have been expelled. At the end of the regimen, the spent refill can then be removed by inserting a coin in the tool slot 131 of the plug connector 24 and twisting counterclockwise one-quarter turn. The spent refill can then be lifted out of the hinged shell 26 and replaced by a fresh refill. The replacement procedure involves seating the refill into the hinged shell 26 by aligning the orienting tabs 59 of the base 27 and the fixturing wall slots 125 of the hinged shell 26 and thereafter locking the refill in place by reversing the plug connector procedure.

The previously described versions of the present invention have many advantages, including the advantage of assuring that the correct pill is always dispensed by removing human error in selection. The filled dispenser 25 is presented to the user with the first sequential pill of the regimen in the operative position aligned with the pointer protrusion 114 and adjacent to the pill exit aperture 57. The only way that the first pill can be expressed from the dispenser 25 is by pushing downward on the plunger 30 thereby advancing the pill container 29 one index position resulting in the release of the first pill. The pill container 29 cannot be rotated clockwise, except by activating the plunger 30, because the limit bar 111 is in an interference position with one of the saw teeth 48. Similarly, the pill container 29 cannot be forced in a counterclockwise direction because the ratchet pawls 84 are abutted against the vertical stops 47 of the ratchet track 45. The only way that the second pill can be accessed is by first dispensing the first pill. In this manner, each pill of the regimen can only be taken in sequence. Another advantage of the present invention is the one-step dispensing procedure. The user has only to push the plunger 30 to simultaneously dispense a pill and index the pill container 29 forward for the next dispensing cycle. Since the periodicity indicator ring 28 advances with the pill container 29, the pill poised in the operative position has an associated indicator of periodicity reminding the user of the correct timing for next dispensing cycle While the material selected for the elements of the dispenser of the present invention is generally left to choice and compatibility with the functions of the dispenser, all components are preferably made of plastic. A commodity resin such as general purpose polystyrene can be conveniently injection molded into the desired configurations while providing sufficient rigidity and durability for extended use. An impact version of polystyrene can give the properties needed for flexibility and toughness. In the absence of opacifiers, polystyrene can have the property of transparency which is useful for the pill container 29. In the preferred embodiment, the hinged shell 26 is made of acrylonitrile butadiene styrene (ABS) which has the properties of hardness and scratch resistance. The method of printing on the ring top surface 85 and the cover 113 is either by hot stamping or by pad printing. While the size of the dispenser 25 is determined by the number of pills in the regimen, it is preferable that it fit in the palm of the user's hand. Typically, the number of pills is twenty-eight and the girth is about 2.8 inches (7.1 cm).

Although the present invention has been described in considerable detail with reference to certain preferred versions thereof, other versions are possible. For example, an alternative means for cyclically indexing the pill container could be a spring recoil mechanism wherein the spring is fixedly connected to the pill container and movably connected to another part having the capability to load the spring and index it forward. Alternative means for lifting the plunger could be a coil spring or a bow spring. An alternative means for orienting the refill unit to the hinged shell could be by tabs of differing sizes or by interlocking apertures. An alternative means for removably connecting the refill unit and the hinged shell could be a slide lock. And, an alternative means for indicating the sequence of pills could be a press-fit ring. Therefore, the spirit and scope of the appended claims should not be limited to the description of the preferred versions contained herein.

What is claimed is:

1. A self-actuating dispenser for a regimen of pills comprising:

(a) a base having a pill exit aperture;

(b) a pill container having pill cells for the containment of pills therein, the pill container movably attached to the base such that any pill cell can be aligned with the pill exit aperture, the pill cells having open bottoms for loading and unloading which are adjacent to the base when attached thereto; and (c) means for cyclically indexing the pill container with respect to the base such that each pill cell in turn is brought into alignment with the pill exit aperture thereby dropping resident pills in a said pill cell from the dispenser; and wherein the means for cyclically indexing comprises a set of vertical saw teeth attached to a circular wall of the pill container concentric with the pill cell array, the saw teeth and pill cells in one to one correspondence with respect to number and regularity, each tooth having an upward-facing ramp face with a pitch to horizontal corresponding to an angular throw equal to the pill cell spacing, and a plunger attached to the base such that the plunger pivots in a vertical plane while remaining torsionally rigid in a horizontal plane, the plunger having a sliding shoe with a downward-facing sliding face complementary to the ramp faces, the sliding shoe located sufficiently distant from the pivot axis for the application of leverage while extending to a position directly above the leading edge of one of the saw teeth such that a downward pivoting force applied to the plunger would bring the sliding face of the sliding shoe into contact with the ramp face of the proximate saw tooth thereby collapsing the inclines into a traversing slide resulting in a rotational thrust of the pill container, the plunger thereafter having means for recycling to the next saw tooth at the completion of the downward pivot stroke.

2. The dispenser of claim 1 wherein the cells of the pill container are evenly spaced about an axis of rotation in the base.

3. The dispenser of claim 1 including a method for single-hand dispensing of pills from said dispenser comprising:

the steps of grasping the plunger, pill container and base assembly between the thumb and fingers of one hand and pressing the plunger downward with the thumb while cupping the hand beneath the pill exit aperture to catch the pill thus expressed.

4. The dispenser of claim 1 wherein the sliding shoe is flexibly attached to the plunger and each saw tooth ramp face has a tilt perpendicular to the pitch which is complemented by a tilt of the sliding face such that the two faces slidably interlock when forced together thereby preventing the sliding shoe from slipping off of the mating saw tooth when the plunger is rotated downward in an arc.

5. The dispenser of claim 4 wherein the means for recycling comprises a bypassing face on the sliding shoe and a complementarily posed overlap face on the next advancing saw tooth such that the faces are vertically interposed at the bottom of the downward pivoting stroke, the inclination of the faces such that the sliding shoe smoothly passes over the advancing tooth to regain the plunger initial position above the tooth when motivated upward by a means for lifting.

6. The dispenser of claim 5 wherein the means for lifting comprises a pair of parallel beam springs attached to the base at a location .between the sliding shoe of the plunger and the pivot axis when the plunger is in assembly with the base and a spreading wedge attached to the plunger in a location such that the wedge is forced between the springs during the downward pivot-stoke creating a potential upward force in the tension of the springs sufficient to return the plunger to the initial position while forcing the sliding shoe to bypass the supraimposed saw tooth.

7. A self actuating, refillable dispenser for a periodic regiment of pills comprising:

a first subassembly comprising:

(a) a base having a first pill exit aperture;

(b) a pill container having pill cells for the containment of pills therein, the pill container movably attached to the base such that any pill cell can be aligned with the pill exit aperture, the pill cells having open bottoms for loading and unloading which are adjacent to the base when assembled thereto;

(c) means for cyclically indexing the pill container with respect to the base such that each pill cell in turn is brought into alignment with the pill exit aperture-thereby dropping resident pills from the dispenser; and a second subassembly comprising:

an outer container sized for protecting and aligning with the first subassembly and capable of being replenished with a first subassembly charged with a fresh load of pills.

8. The dispenser of claim 7 wherein the pill container is essentially circular.

9. The dispenser of claim 8 wherein the outer container comprises a cupped bottom and a top hinged together on one end and latched at the other, the bottom having a pill release aperture positioned to coincide with the pill exit aperture when the base and loaded pill container subassembly is aligned to the outer container with means for orienting and held in place with means for removably connecting thereby allowing convenient dispensing without removal of the subassembly from the outer container.

10. The dispenser of claim 9 wherein the means for orienting comprises interlocking geometries distributed between the base and bottom such that the geometries of the base match to the complementing geometries of the bottom in only one position of the subassembly relative to the bottom.

11. The dispenser of claim 9 wherein the means for removably connecting is a plug with lateral extensions at both ends which clamp the bottom and base therebetween when one end of the plug is inserted through mating apertures in the bottom and base and thereafter twisted by means for twisting.

12. The dispenser of claim 11 wherein the mean for twisting is a coin slot located in the bottom surface of the plug.

13. A self-actuating, sequence-indicating dispenser for a periodic regimen of pills comprising:

(a) a base having a pill exit aperture;

(b) a pill container having pill cells for the containment of pills therein, the pill container movably attached to the base such that any pill cell can be indexed over the pill exit aperture, the pill cells having open bottoms for loading and unloading which are adjacent to the base when assembled thereto;

(c) means for cyclically indexing the pill container with respect to the base such that each pill cell in turn is brought into alignment with the pill exit aperture thereby dropping resident pills from the dispensers; and (d) means for indicating the sequence of pills, which can be adjusted to a specific therapy;

wherein the pill container has a circular outer wall and the pill cells are circularly arrayed with even spacing about an axis of rotation in the base, the pill cells numbering the pills, the pill cell initially positioned over the pill exit aperture of the base having means for temporary suspension of the pill contained therein;

wherein the means for temporary suspension comprises a spring finger attached to the base which is inserted into the exposed pill cell through an aperture upon assembly of the base and pill container and which cradles the pill long enough for the cell to transition over the base thereby closing the bottom of the pill cell and trapping the resilient pill, the spring finger deflecting synchronously from the interior space of the pill cell to a space exterior of the pill container for the remainder of the dispensing regimen by the interaction of cam surfaces on the spring finger and pill container.

14. A self-actuating, sequence-indicating dispenser for a periodic regimen of pills comprising:

(a) a base having a pill exit aperture;

(b) a pill container having pill cells for the containment of pills therein, the pill container movably attached to the base such that any pill cell can be indexed over the pill exit aperture, the pill cells having open bottoms for loading and unloading which are adjacent to the base when assembled thereto;

(c) means for cyclically indexing the pill container with respect to the base such that each pill cell in turn is brought into alignment with the pill exit aperture thereby dropping resident pills from the dispensers; and (d) means for indicating the sequence of pills, which can be adjusted to a specific therapy;

wherein the pill container has a circular outer wall and the pill cells are circularly arrayed with even spacing about an axis of rotation in the base, the pill cells numbering the pills, the pill cell initially positioned over the pill exit aperture of the base having means for temporary suspension of the pill contained therein;

wherein the means for indicating comprises a ring encircling the pill container and having means for moveable attachment thereto, the means for moveable attachment providing for changeable settings of the ring relative to the pill container while maintaining the setting when the pill container is indexed forward, the ring having a top surface imprinted with indicators of periodicity such that the indicators and the pill cells are in one to one correspondence with each setting, and a stationary indicating feature to provide a reference point for the operating indicator of periodicity.

15. The dispenser of claim 14 wherein the indicators of periodicity are days of the week and the number of pills is an even multiple of seven.

16. The dispenser of claim 14 wherein the means for moveable attachment comprises a plurality of bosses flexibly attached to the ring which slidably seat to notches in the outer wall, the spacing of notches and bosses such that a registry is obtained at each pill cell, and a means for retaining the ring in assembly between the pill container and the base.

17. The dispenser of claims 6 or 16 further comprising means for positive one-way positioning of the pill container with respect to the pill exit aperture of the base.

18. The dispenser of claim 17 wherein the means for positive one-way positioning comprises a means for ratcheting interposed between the pill container and base.

19. A self-actuating, sequence-indicating, refillable dispenser for a periodic regimen of pills comprising:

(a) an essentially circular base having a flat platform, an axis-of-rotation perpendicular to the center of the platform, a pill exit aperture at the periphery of the platform, a spring finger attached to the base at the periphery and extending into the space above the pill exit aperture, two vertical cradle struts rigidly mounted to the platform with opposing cradle recesses in the ends, the cradle recesses defining therebetween an axis perpendicular to the axis-of-rotation, and two vertical parallel beam springs attached to the platform between the pill exit aperture and the axis perpendicular to the axis-of-rotation, the parallel beam springs and the cradle struts straddling a common bisecting line passing through the axis of rotation;

(b) a pill container having pill cells arrayed evenly about a circle having a radius equal to the distance between the pill exit aperture and the axis-of-rotation, an inner wall and an outer wall connected by a top surface surrounding the pill cells which are enclosed except for bottom openings, a last pill cell reserved for the last sequential pill of the regimen, a last pill aperture opening into the last pill cell for insertion of the spring finger serving to suspend the last pill when located above the pill exit aperture, means for camming the spring finger out of the way of the pill cell without expressing the last pill when the pill container is advanced, vertical channels in the outer wall corresponding in number and interval to the pill cells, a circular aperture in the center of the pill container sized to circumscribe the parallel beam springs and the cradle struts, a base flange between the circular aperture and the bottom of the inner wall, means for rotatably retaining the pill container when the pill container is assembled to the base centered on the axis-of-rotation with the last pill cell over the pill exit aperture, the base forming a bottom to the pill cells thereby containing the pills until each pill cell is advanced over the pill exit aperture causing the resident pill to drop through, means for ratcheting interposed between the pill container and the base for regulating clockwise-only motion, and a set of Vertical saw teeth corresponding to the pill cells in count and interval, the saw teeth comprising one half of a sliding inclined plane set having a pitch and stroke sufficient to rotate the pill container one index position, the saw teeth and the means for ratcheting oriented to the pill cells such that each index position corresponds to the alignment of a pill cell with the pill exit aperture, each saw tooth having an upward facing ramp face forming an acute angle with the inner wall and a downward facing overlap face forming an oblique angle with the inner wall;

(c) a periodicity indicator ring for encircling the pill Container having a ring top surface imprinted with indicators of periodicity corresponding to the pill cells in :number and interval, a ring wall attached to the inner rim of the ring top surface, a plurality of tangential springs attached to the ring wall terminating in rounded ring pawls, the ring pawls biased against the lo outer wall of the pill container when assembled thereto by the tangential springs, the ring pawls evenly spaced such that they simultaneously seat to a set of vertical channels, each such seating providing a unique alignment of the indicators of periodicity with the pill cells which is maintained by interlock of the ring pawls in the vertical channels during transportation of the pill container, the alignment made variable by rotating the periodicity indicator ring about the pill container, the rotation urging the pawls to flex outward into the intervening space between the ring wall and the outer wall, and second means for rotatably retaining the periodicity indicator in assembly between the pill container and the base;

(d) a plunger having a plunger base with a slotted extension, a pivot attached to the plunger base dimensioned to seat within the cradle recesses with provision for freedom to pivot, a spreading wedge attached to the plunger base between the pivot and slotted extension, the slotted extension, spreading wedge and pivot located linearly to coincide with the saw teeth, the parallel beam springs and the cradle recesses, respectively, of the base and pill container subassembly, means for pivotally retaining the plunger to the base, the spreading wedge acting to spread the parallel beam springs apart when a downward pivoting force is applied to the plunger thereby creating the potential for a reciprocating force, a sliding shoe flexibly attached to the end of the slotted extension forming the second half of the sliding inclined plane set, the sliding shoe having an angled extension for insertion between the saw teeth thereby establishing an underlap with an advancing saw tooth at the finish of a pivot stroke, the angled extension initiating the pivot stroke above the leading edge of the operating saw tooth, the angled extension having a downward-facing sliding face with inclinations complementary to that of the ramp face such that the sliding face moving downward against the ramp face causes the contacting faces to interlock while moving opposite to each other thus imparting torque to the pill container and causing a rotational movement of the pill container with respect to the base and plunger, the angled extension further having an upward-facing bypassing face with an inclination to vertical complementary to that of the overlap face such that the composite structure of the sliding shoe and the slotted extension is flexed inward when the bypassing face moves upward against the overlap face by the sliding interaction of the vertical angles driven by the reciprocating force of the parallel beam springs thereby allowing the angled extension to transition over the thickness of the advancing saw tooth to regain position for the next indexing cycle, means for limiting the upward and downward extents of the pivoting stroke thereby providing regulation of indexing movement, means for preventing rotation of the pill container except when the plunger is pivoted, and an indicating feature on the plunger providing a reference point for the operating indicator of periodicity; and, (e) a hinged shell having cupped bottom and top elements dimensioned for containing the subassembly of the base, pill container, indicator of periodicity ring and plunger, the subassembly comprising a refill unit when loaded with a regimen of pills, the bottom element having a pill release aperture positioned to coincide with the pill exit aperture thereby providing conduit for the pills, means for orienting the refill unit to the hinged shell for alignment of the pill release aperture and the pill exit aperture, and means for removably connecting the refill unit to the hinged shell.

20. The dispenser of claim 19 wherein the means for orienting comprises a circular fixturing wall attached to the bottom to encircle and laterally contain the refill unit, the fixturing wall having a plurality of vertical fixturing wall slots, and the base having an equal or lessor plurality of orienting tabs extending radially outward to interlock with the fixturing wall slots, the orienting tabs and fixturing wall slots asymmetrically arrayed to match in a unique orientation at which assembly of the refill unit to the hinged shell is permitted.

21. The dispenser of claim 20 wherein the means for removably connecting comprises aligned apertures in the bottom element and in the base to receive a plug connector, the plug connector having a tubular body and a base flange at one end to abut the bottom element, the tubular body having one or more key tabs at the other end extending laterally outward to overlap the platform when the plug connector is twisted therein, the platform supporting underlapping detents to register the key tabs at the raised end of spiraling ramps, the key tabs passing through keyways in the apertures located adjacent to the spiraling ramps to ride up the spiraling ramps upon application of a force twisting in the direction sense of the spiraling ramps, the tubular body having a length sufficient to snugly lock the refill unit and hinged shell together when the key tabs are seated in the detents, and a tool slot in the bottom of the base flange for insertion of a coin, or other tool, therewith to twist the plug connector.

22. The dispenser of claim 21 further comprising means for locking pivotal movement of the plunger when the refill unit is disconnected from the protective hinged shell.

23. The dispenser of claim 22 wherein the means for locking pivotal movement comprises a flexible beam attached to the plunger base in a location giving proximity to one of the detents when the plunger is assembled to the base, the proximate detent having a level surface to receive the abutting face of the flexible beam inclined thereto thereby forming a buttress, the beam experiencing deflection when the refill unit is loaded into the hinged shell and one of the key tabs is twisted into the detent thereby camming aside the flexible beam, the flexible beam thus deflected thereafter free to pivot downward into the space provided by the elevation of the detent above the platform thereby unlocking the plunger.

24. A method of assembling a dispenser for a periodic regimen of pills, the dispenser having a base, a pill container containing a plurality of pill cells arrayed circumferentially thereabout, a periodicity indicator ring, a plunger, a hinged shell and a plug connector as components thereof comprising the steps of:

(a) loading the pills clockwise into the pill cells of the pill container beginning with the first sequential pill of the regimen and thereafter continuing in a clockwise circuit, into the pill container;

(b) placing the periodicity indicator ring around the pill container;

(c) connecting the base to the subassembly of the previous step (b);

(d) connecting the plunger to the subassembly of step (c) after turning it over;

(e) positioning the unit assembled in the previous steps for reception to the hinged shell; and (f) inserting the plug connector into the assembly of the previous step (e) and twisting the plug connector to lock the assembly together.

* * * * *

UNITED STATES PATENT AND TRADEMARK OFFICE

CERTIFICATE OF CORRECTION

PATENT NO. : 5,664,697

DATED : September 9, 1997

INVENTOR(S) : Lawrence E. Lambelet, Jr.; Thomas A. Frazier

It is certified that error appears in the above-indentified patent and that said Letters Patent is hereby corrected as shown below:

Claim 13, column 17, line 5 "resilient" should be -- resident --.

Claim 19, column 18, line 51 delete "lo" at the end of the line.

Signed and Sealed this

Eleventh Day of November, 1997

Bruce Lehman

*Attest:*

BRUCE LEHMAN

*Attesting Officer*

*Commissioner of Patents and Trademarks*

US005664697B1

REEXAMINATION CERTIFICATE (3628th)

United States Patent [19] [11] B1 5,664,697

Lambelet, Jr. et al. [45] Certificate Issued Sep. 15, 1998

[54] AUTOMATICALLY ADVANCING PILL REGIMEN DEVICE

[75] Inventors: Lawrence E. Lambelet, Jr., Flemington, N.J.; Thomas A. Frazier, Williamsport, Pa.

[73] Assignee: Ortho Pharmaceutical Corporation, Raritan, N.J.

Reexamination Request:
No. 90/004,849, Nov. 25, 1997

Reexamination Certificate for:

| | |
|---|---|
| Patent No.: | **5,664,697** |
| Issued: | **Sep. 9, 1997** |
| Appl. No.: | **551,223** |
| Filed: | **Oct. 31, 1995** |

Certificate of Correction issued Nov. 11, 1997.

[51] Int. Cl.[6] ..... G07F 11/00

[52] U.S. Cl. ..... 221/5; 221/86; 221/89; 206/533

[58] Field of Search ..... 221/82, 83, 86, 221/89, 91, 4, 5, 282; 206/533, 538, 539

[56] References Cited

U.S. PATENT DOCUMENTS

| | | | |
|---|---|---|---|
| 3,437,236 | 4/1969 | Huck | 221/86 |
| 3,557,747 | 1/1971 | Rigney et al. | 206/533 |
| 3,895,737 | 7/1975 | Phillips | 221/82 |
| 3,984,031 | 10/1976 | Thompson | 221/82 |
| 4,078,661 | 3/1978 | Thomas | 206/533 |
| 4,128,188 | 12/1978 | White | 221/91 |
| 4,165,709 | 8/1979 | Studer | 221/5 |
| 4,646,936 | 3/1987 | Frazier et al. | 221/86 |
| 5,154,296 | 10/1992 | Cutler | 221/91 |
| 5,409,132 | 4/1995 | Kooijmans et al. | 221/86 |

FOREIGN PATENT DOCUMENTS

| | | | |
|---|---|---|---|
| 1187060 | 4/1970 | United Kingdom | 221/82 |
| WO 990/13878 | 11/1990 | WIPO | G07F 11/00 |

*Primary Examiner*—H. Grant Skaggs

[57] ABSTRACT

The present invention is directed to a self-actuating dispenser for a regimen of pills satisfying the needs discussed herein above. A self-actuating dispenser having the features of the present invention comprises a base, a pill container, and a means for cyclically indexing the pill container with respect to the base. The base has a pill exit aperture. The pill container, which houses the pills in individual compartments or cells, is movably attached to the base such that any pill cell can be aligned with the pill exit aperture. The pill cells are provided with open bottoms for loading and dispensing which are covered over by the base when attached thereto. The means for cyclically indexing provides that each pill cell in turn is brought into alignment with the pill exit aperture thereby singly dropping the resident pills in a series of dispensing cycles.

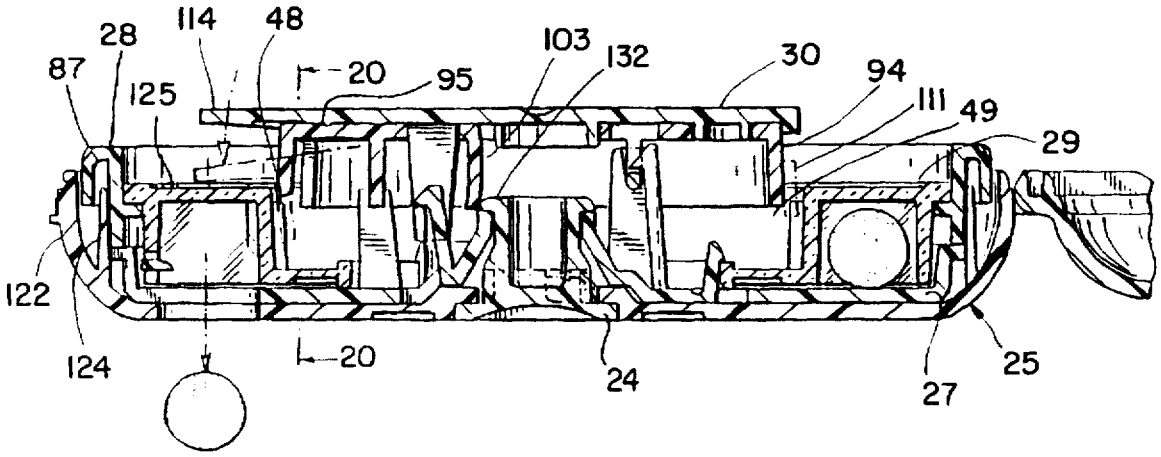

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–24 is confirmed.

* * * * *